US007726518B2

(12) United States Patent
Brouwer

(10) Patent No.: US 7,726,518 B2
(45) Date of Patent: Jun. 1, 2010

(54) DISPENSER FOR CONCENTRATED INJECTION

(75) Inventor: Markus Franciskus Brouwer, Heesch (NL)

(73) Assignee: MeadWestvaco Calmar Netherlands B.V. (NL)

( * ) Notice: Subject to any disclaimer, the term of this patent is extended or adjusted under 35 U.S.C. 154(b) by 741 days.

(21) Appl. No.: 10/573,124

(22) PCT Filed: Sep. 23, 2004

(86) PCT No.: PCT/NL2004/000660

§ 371 (c)(1),
(2), (4) Date: Dec. 15, 2006

(87) PCT Pub. No.: WO2005/028121

PCT Pub. Date: Mar. 31, 2005

(65) Prior Publication Data

US 2008/0237265 A1 Oct. 2, 2008

(30) Foreign Application Priority Data

Sep. 23, 2003 (NL) ..... 1024350

(51) Int. Cl.
*B05B 11/00* (2006.01)
*B05B 7/00* (2006.01)

(52) U.S. Cl. ..... 222/145.6; 222/190; 222/321.7; 222/321.9; 137/895

(58) Field of Classification Search ..... 222/145.6, 222/190, 321.7, 321.9; 137/891, 895
See application file for complete search history.

(56) References Cited

U.S. PATENT DOCUMENTS

| | | | | |
|---|---|---|---|---|
| 4,932,567 | A * | 6/1990 | Tanabe et al. | 222/190 |
| 5,779,104 | A * | 7/1998 | Reidel | 222/190 |
| 6,536,629 | B2 * | 3/2003 | van der Heijden | 222/190 |
| 6,612,468 | B2 * | 9/2003 | Pritchett et al. | 222/190 |
| 2002/0056730 | A1 * | 5/2002 | van de Heijden | 222/190 |
| 2003/0015552 | A1 * | 1/2003 | Bistolfi | 222/190 |

* cited by examiner

*Primary Examiner*—Kenneth Bomberg

(57) ABSTRACT

A dispenser, particularly suitable for a liquid container, comprising a liquid pump provided with an inlet having an inlet valve and an outlet having an outlet valve, an air pump provided with an inlet having an inlet valve and an outlet having an outlet valve, a mixing chamber which is in communication with the outlet of each pump, and a dispensing part provided with an outflow channel with an outflow opening, wherein the outflow channel is in communication with the mixing chamber, and wherein the outlet valve of the air pump is arranged adjacent to the outlet of the liquid pump.

6 Claims, 6 Drawing Sheets

DISPENSER FOR CONCENTRATED INJECTION

The invention relates to a dispenser, particularly suitable for a liquid container, comprising a liquid pump provided with an inlet having an inlet valve and an outlet having an outlet valve, an air pump provided with an inlet having an inlet valve and an outlet having an outlet valve, a mixing chamber which is in communication with the outlet of each pump, and a dispensing part provided with an outflow channel with an outflow opening, wherein the outflow channel is in communication with the mixing chamber.

Such a dispenser can be used to dispense a spray or a foam. Such a dispenser preferably produces a spray or foam of the highest possible quality, which entails the air bubbles in the spray or the foam being distributed as finely and uniformly as possible.

A dispenser of the present type is known from EP 0 618 147. The outlet valve of the air pump is adjacent to the outlet of the liquid pump.

The object of the present invention is to improve known dispensers.

The present invention provides for this purpose a dispenser which is characterized in that the outlet valve for air, which is adjacent to an outlet for the liquid pump, is formed by a flexible wall. Although a minimal leakage need not affect the functioning of the dispenser, the flexible wall seals. In the case of some liquids a sudden opening of the air valve to generate an "explosion" of air is found to be necessary to obtain a good foam or spray. Such an outlet valve for air can be manufactured in relatively simple and inexpensive manner.

The air in the air pump is compressed, and the pressure therefore increases. When a determined pressure difference is reached over the air valve, it will open. The resistance which must be overcome is here the valve resistance and the underlying liquid pressure of liquid flowing past the valve. The air can hereby be injected under great pressure directly into the liquid. Experiments have shown that a spray or foam of improved quality can hereby be obtained. The flexible wall is movable in the liquid flow.

The outlet valve of the air pump is preferably positioned relative to the outlet of the liquid pump such that when the valve is opened the air is introduced almost transversely of the liquid flow. Experiments have once again shown that this enhances the quality of the spray or the foam.

In a further embodiment according to the invention the outlet of the liquid pump comprises a liquid chamber which, as seen in flow direction, is situated after the outlet valve of the liquid pump and which is provided with a central opening which debouches in the mixing chamber. During compression of the air in the air pump the liquid chamber is filled with liquid from the liquid container. Via the central opening in the liquid chamber the liquid flows into the mixing chamber where, after sufficient build-up of pressure, air is introduced into the liquid.

The mixing chamber preferably comprises a central outlet opening which debouches in the outflow channel of the dispensing part. The air-liquid mixture is thus forced to leave the mixing chamber through a relatively small opening. This also enhances the quality of the foam or the spray.

In a preferred embodiment a flexible wall is arranged between the liquid chamber and the mixing chamber. In the static situation the valve seals around the central outlet opening of the mixing chamber.

The central opening of the liquid chamber is preferably in open communication with the outflow channel of the dispensing part. Liquid leaves the liquid chamber through the central opening in the direction of the outflow channel.

The dispenser according to the invention is particularly intended as foam dispenser, wherein a foam-forming element is arranged in the outflow channel.

The foam-forming element is preferably arranged in the outflow channel such that the foam flowing through the outflow channel passes through the foam-forming element at least twice. A finer and more uniform foam is hereby found to result which is unsurpassed by any known foam-forming unit. The production process is furthermore simpler since only one foam-forming element is arranged for two passages, which has the effect of saving costs.

For a further improvement in the foam quality, a further foam-forming element can be arranged, as seen in the flow direction, before or after the foam-forming element that is passed through twice. In a particularly advantageous embodiment according to the invention, the final foam-forming element, as seen in the flow direction, is preferably arranged in the outflow opening. The foam-forming element forms resistance at the outer end of the dispensing part, so that the foam does not spurt out of the outflow channel, and thereby remains more stable.

Finally, the invention relates to a dispenser assembly consisting of a liquid container and a dispenser according to the invention.

The invention will be further elucidated hereinbelow with reference to the accompanying drawings. In the drawings.

Figure 5:
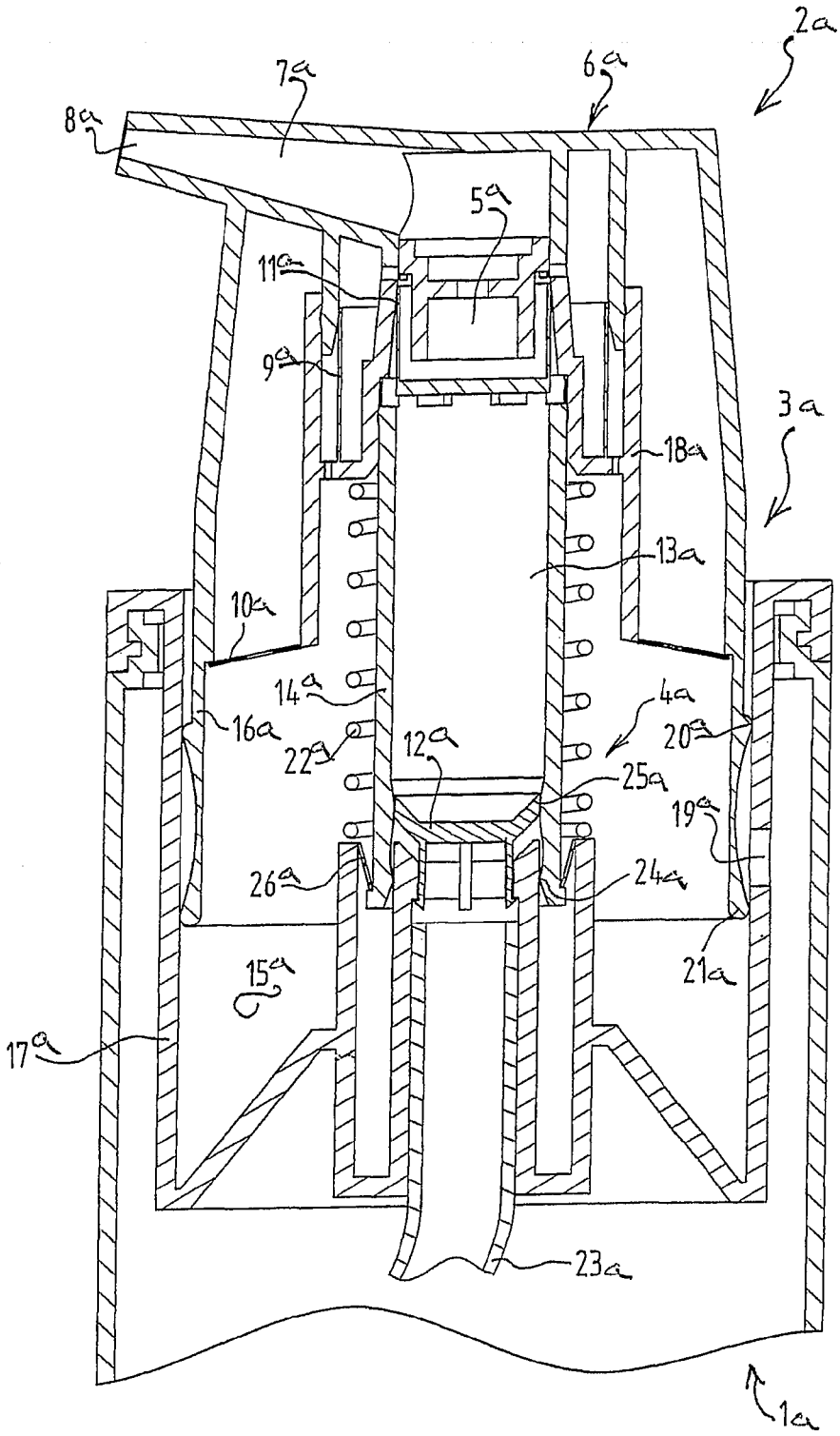
FIG. 5 (PRIOR ART)
FIG. 5 illustrates a cross-section of a foam dispensing assembly of the prior art.

In the perspective, cross-sectional view of FIG. 5 is shown a foam dispensing assembly of the prior art consisting of a liquid container 1*a* and a foam forming unit 2*a*. The foam forming unit 2*a* comprises a pump 3*a* for air and a pump 4*a* for liquid which are each provided with an inlet and an outlet. The inlet of air pump 3*a* is in communication with the environment, while the inlet of liquid pump 4*a* is in communication with the content of liquid container 1*a*. Foam forming unit 2*a* further comprises a mixing chamber 5*a* which is in communication with the outlet of both air pump 3*a* and liquid pump 4*a*.

On the top part of the assembly is situated a dispensing part 6*a* which is provided with an outflow channel 7*a* with a foam opening 8*a*. Outflow channel 7*a* runs from mixing chamber 5*a* to foam opening 8*a*. One or more foam forming elements are normally located in this channel 7*a*.

Both the outlet and the inlet of each pump 3*a*, 4*a* are provided with a valve respectively 9*a*, 10*a*, 11*a*, 12*a* for delivering respectively drawing in air or liquid.

Liquid pump 4*a* comprises a pressure chamber 13*a* with a piston 14*a* which is displaceable relative to pressure chamber 13*a*. It is otherwise noted that the term "piston" is understood to mean that part of the pump which is moved. Pressure chamber 13*a* is further located between inlet valve 12*a*, outlet valve 11*a* and piston 14*a* of liquid pump 4*a*. In addition, air pump 3*a* comprises a pressure chamber 15*a* with a piston 16*a* which is displaceable relative to pressure chamber 15*a*. Pressure chamber 15*a* of air pump 3*a* is bounded on one side by inlet valve 10*a* and outlet valve 9*a* and on the other side between pistons 14*a*, 16*a* of the two pumps 3*a*, 4*a*, these pistons being placed concentrically relative to each other.

An operating member for operating the two pumps 3*a*, 4*a* is manufactured integrally with piston 16*a* of air pump 3*a*. The operating member 16*a*, or the piston 16*a* of air pump 3*a*, is arranged slidably in a holder element 17*a* which holds the foam forming unit 2*a* in liquid container 1*a*. Upon displacement of operating member 16*a*, this movement is transmitted directly onto piston 16*a* to operate air pump 3*a*. When operating member 16*a* is displaced the liquid pump 4*a* is also operated in that a coupling element 18*a* is arranged between operating member 16*a* and the piston 14*a* of liquid pump 4*a*, which coupling element transmits the displacement of operating member 16*a* to piston 14*a* of liquid pump 4*a*. Finally, it should also be noted that dispensing part 6*a* is in fact formed integrally with operating member 16*a*, or the piston 16*a* of air pump 3*a*.

Figure 1:
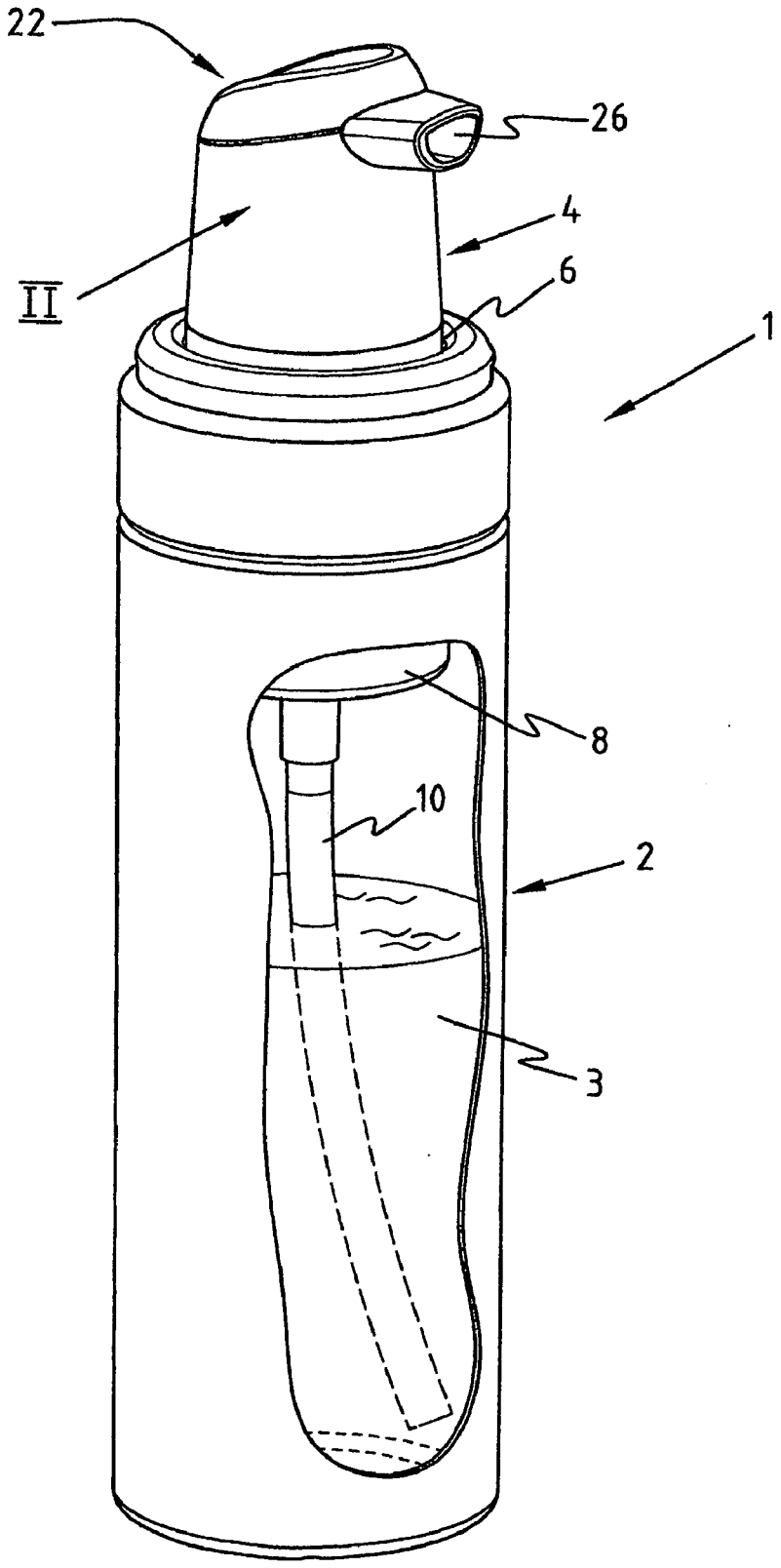
FIG. 1 shows a perspective, partly cut-away dispenser assembly according to the invention.
Figure 2:
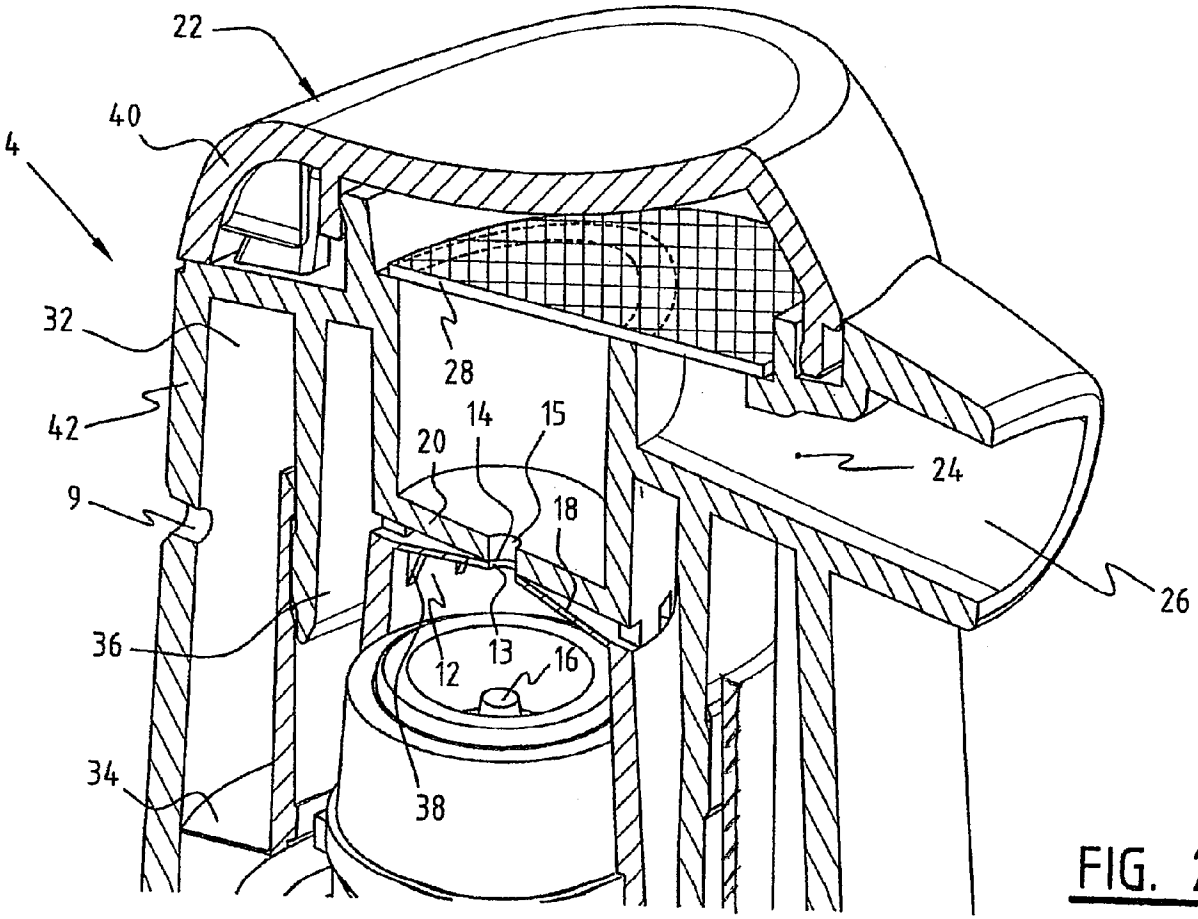
FIG. 2 shows a perspective view in cross-section of a detail of a foam dispenser according to a first embodiment.

A dispenser assembly 1 according to the present invention comprises a cylindrical liquid container 2 which has therein a liquid 3 for atomizing or foaming and on which is arranged a dispenser 4 (FIG. 1). Dispenser 4 comprises a pump 6 for air and a pump 8 for liquid, which are each provided with an inlet and an outlet. Air pump 6 is in communication with the environment via opening 9 (FIG. 2), while liquid pump 8 is in communication with the content 3 of liquid container 2 via hose 10. Dispenser 4 further comprises a mixing chamber 14 which is in communication with both the air pump 6 and the liquid pump 8. The outlet of mixing chamber 14 is formed by a central outlet opening 15 in wall 20. The outlet of liquid pump 8 comprises an outlet valve 16 and a liquid chamber 12 which is located thereabove and provided with a central opening 13 debauching in mixing chamber 14. An outlet valve 18 for air is located in the outlet of air pump 6 (FIG. 2).

The top part of the assembly comprises a dispensing part 22, comprising an outflow channel 24 with an outflow opening 26. Outflow channel 24 runs from mixing chamber 14 to outflow opening 26. In this channel 24 are arranged one (FIG. 2) or two (FIG. 3) foam-forming elements, in the shown preferred embodiment in the form of relatively fine-mesh screens 28,30. Reference is made in respect of these screens, and in particular in respect of specific dimensioning thereof, to patent application NL 1022633, the content of which is hereby incorporated by reference.

The opening 9 for admitting air into air pump 6 is provided in dispensing part 22. The inlet of air pump 6 further comprises an air chamber 32. The air inlet is bounded by inlet valve 34. A compression chamber 36 for air is arranged between inlet valve 34 and outlet valve 18 for air.

The outlet valve 18 for air is formed by a flexible wall which forms a wall for both liquid chamber 12 and mixing chamber 14. In the static situation the flexible wall 18 seals round the central outlet opening 15 of mixing chamber 14. The flexible wall is provided with central opening 13 which forms the outlet of liquid chamber 12. This central opening 13 is in open communication with outflow channel 24 of dispensing part 22 via mixing chamber 14 and the central outlet opening 15 of mixing chamber 14.

On the underside of flexible wall 18 there are provided stop means 38 with which the outlet valve 16 for liquid comes into contact in the maximum opened position. Stop means 38 serve to prevent the outlet valve 16 for liquid influencing the operation of outlet valve 18 for air. These stops also ensure that the outlet valve 16 for liquid does not close off the liquid flow. During the downward stroke of dispenser 4 the outlet valve 16 is lifted by the liquid flow. These ribs 38 are arranged to prevent the valve 16 sealing the outflow opening 13.

The manner in which dispenser 4 and assembly 1 are further constructed is described and shown in international patent application WO 02/42005 of applicant, the content of which is hereby incorporated by reference.

Figure 4A:
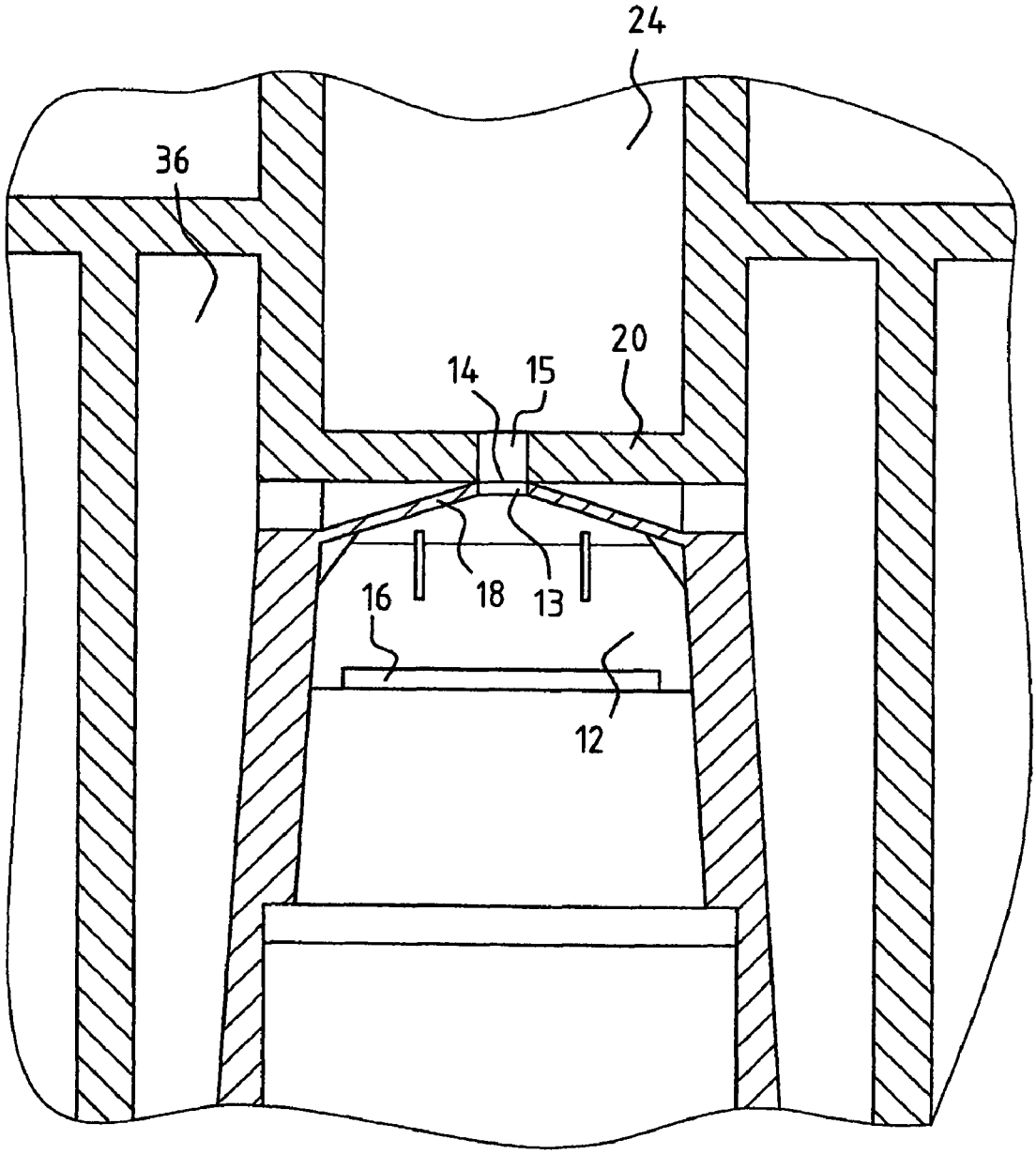
FIGS. 4A and 4B are partly cross-sectional views of the dispenser shown in FIGS. 2 and 3 with respectively closed and open outlet valve for air.
Figure 4B:
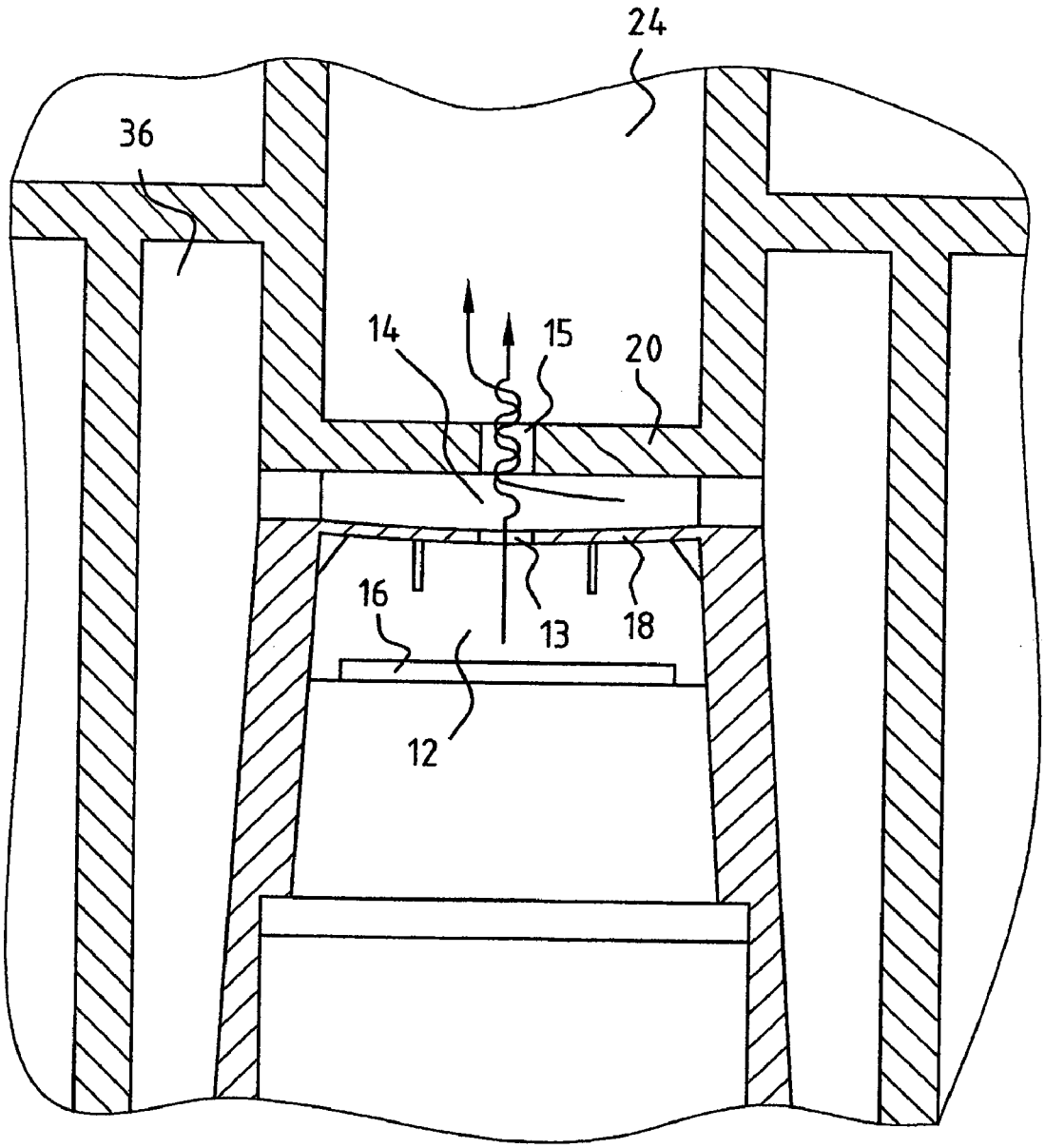

The operation of assembly 1 will be elucidated with reference to FIGS. 4A and 4B. In FIG. 4A the outlet valve 18 for air is shown in the static situation. In the static situation the valve 18 seals round outlet opening 15 of mixing chamber 14. Air is situated in compression space 36 and owing to the sealing cannot displace to mixing chamber 14. Liquid is situated in liquid chamber 12. Via central opening 13 of liquid chamber 12 and the central outlet opening 15 of mixing chamber 14 the liquid chamber 12 is in open communication with outflow channel 24. The pressure in the liquid chamber is therefore equal to atmospheric pressure. In this situation the user presses on dispensing part 22. Dispensing part 22 is hereby moved downward relative to container 12 while co-displacing the pistons (not shown) of air pump 6 and liquid pump 8. During a downward stroke of dispensing part 22 the air in compression space 36 is compressed. The pressure will hereby increase. When the pressure in compression space 36 has reached a predetermined value, the resistance of air valve 18 can be overcome, and flexible wall 18 can bend downward, whereby an open connection is created between compression space 36 and mixing chamber 14. At that moment the air under pressure will be injected with great force into the liquid flow which comes from liquid chamber 12 through central opening 13, mixing chamber 14 and the central outlet opening 15 of mixing chamber 14. Because the outlet valve 18 of the air pump is positioned relative to the outlet of liquid pump 8, the air is introduced practically transversely of the liquid flow when valve 18 is opened. The position with opened air valve 18 is shown in FIG. 4B. Because air escapes from compression space 36, the pressure will fall until eventually the resistance of valve 18 is no longer overcome. Valve 18 will then close (FIG. 4A). Reference is made to WO 02/42005 for the further operation of dispenser assembly 1.

The central outlet opening 15 of mixing chamber 14 preferably has a diameter of between about 0.5 and 4 mm, more preferably a diameter of between about 1 and 2 mm. The highly concentrated injection of air into the liquid channel creates an intensive mixing. It has been shown experimentally that this produces a higher quality of foam. It is possible, owing to pressure differences over air valve 18 during injection, that there occurs high-frequency opening and closing of valve 18.

Figure 3:
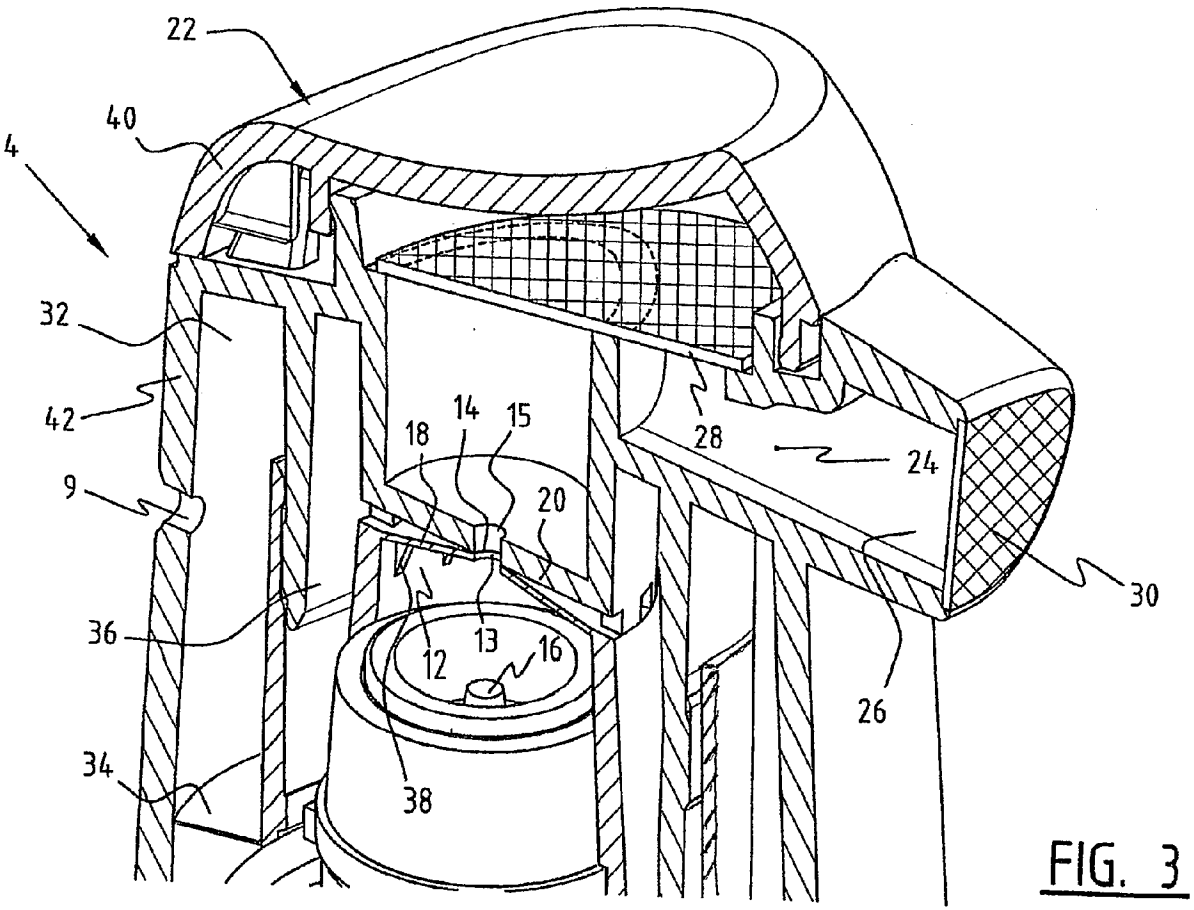
FIG. 3 shows a perspective view in cross-section of a detail of a foam dispenser according to a second embodiment.

Instead of opening 9 in the side wall of dispenser 4, it is also possible to connect air pump 6 to the environment via a gap (not shown) arranged between cap 40 and side wall 42. Situated under cap 40 is a tube which serves as chimney and allows the air from the gap through to air chamber 32. This construction is shown in FIG. 3 of NL 1022633.

Although the invention in the drawings is elucidated for the purpose of making foam, the invention is not limited to foam. The concentrated injection of air by means of an outlet valve located adjacently of the outlet for liquid can also be applied for the purpose of making a spray.

The invention claimed is:

1. A dispenser for a liquid container comprising:

a liquid pump provided with an inlet having an inlet valve and an outlet having an outlet valve;

a liquid chamber in communication with the outlet valve of the liquid pump;

a mixing chamber in communication with the liquid chamber;

an air pump provided with an inlet having an inlet valve and an outlet having an outlet valve, wherein the outlet valve comprises a flexible wall arranged between the liquid chamber and the mixing chamber and projecting substantially transversely of liquid flow through the mixing chamber;

a central opening in the flexible wall; and a dispensing part provided with an outflow channel with an outflow opening, wherein the outflow channel is in communication with the mixing chamber.

2. The dispenser according to claim 1, wherein the mixing chamber comprises a central outlet opening which debouches in the outflow channel of the dispensing part.

3. The dispenser of claim 2, wherein the flexible wall seals around the central outlet opening of the mixing chamber in a static situation.

4. The dispenser of claim 1, wherein the central opening in the flexible wall is in open communication with the outflow channel of the dispensing part.

5. The dispenser of claim 1, further comprising a foam-forming element arranged in the outflow channel.

6. The dispenser of claim 5, further comprising a second foam-forming element arranged in the outflow channel.

* * * * *